United States Patent [19]

Davies

[11] 4,368,695

[45] Jan. 18, 1983

[54] SUPPORTING THE WEIGHT OF A STRUCTURE IN A HOT ENVIRONMENT

[75] Inventor: Peter Davies, Esher, England

[73] Assignee: Exxon Research and Engineering Co., Florham Park, N.J.

[21] Appl. No.: 265,805

[22] Filed: May 28, 1981

[51] Int. Cl.[3] ..... F22B 37/24

[52] U.S. Cl. ..... 122/510; 122/512; 432/234

[58] Field of Search ..... 122/510, 512; 165/81, 165/82, 156; 432/233, 234, 238, 251

[56] References Cited

U.S. PATENT DOCUMENTS

| | | | |
|---|---|---|---|
| 2,344,269 | 3/1944 | Saco, Jr. | 122/512 |
| 2,355,892 | 8/1944 | Praeger | 122/510 |
| 2,908,486 | 10/1959 | Thornburg | 165/156 |
| 3,163,155 | 12/1964 | Culver | 122/510 |
| 3,259,112 | 7/1966 | Lee | 122/510 |
| 3,835,920 | 9/1974 | Mondt | 122/510 |
| 3,885,530 | 5/1975 | Kivlen et al. | 122/510 |
| 4,079,702 | 3/1978 | Funukawa et al. | 122/510 |
| 4,245,982 | 1/1981 | Radoux et al. | 432/233 |
| 4,246,872 | 1/1981 | Skinner et al. | 122/510 |
| 4,305,453 | 12/1981 | Wagner | 165/82 |

FOREIGN PATENT DOCUMENTS

| | | | |
|---|---|---|---|
| 138712 | 2/1919 | United Kingdom | 432/234 |
| 1510697 | 5/1978 | United Kingdom . | |

*Primary Examiner*—Henry C. Yuen

*Attorney, Agent, or Firm*—Donald F. Wohlers

[57] ABSTRACT

At least part of the weight of a structure (such as a bank of heat recovery tubes) exposed to a hot environment (e.g. the convection region of a furnace) is supported by a multi-pipe heat exchanger of which the outer pipe has dimensions at least adequate to bear the imposed load, and the inner pipe(s) are so dimensioned in relation to the outer pipe as to maintain the outer pipe at a temperature at which its load-bearing strength is maintained for a reasonable and/or acceptable cooling fluid flow rate through the heat exchanger. In one embodiment, the heat exchanger is of the double pipe type, and the cooling fluid may be circulated from the heat exchanger to the bank of heat recovery tubes.

4 Claims, 2 Drawing Figures

SUPPORTING THE WEIGHT OF A STRUCTURE IN A HOT ENVIRONMENT

Figure 1:
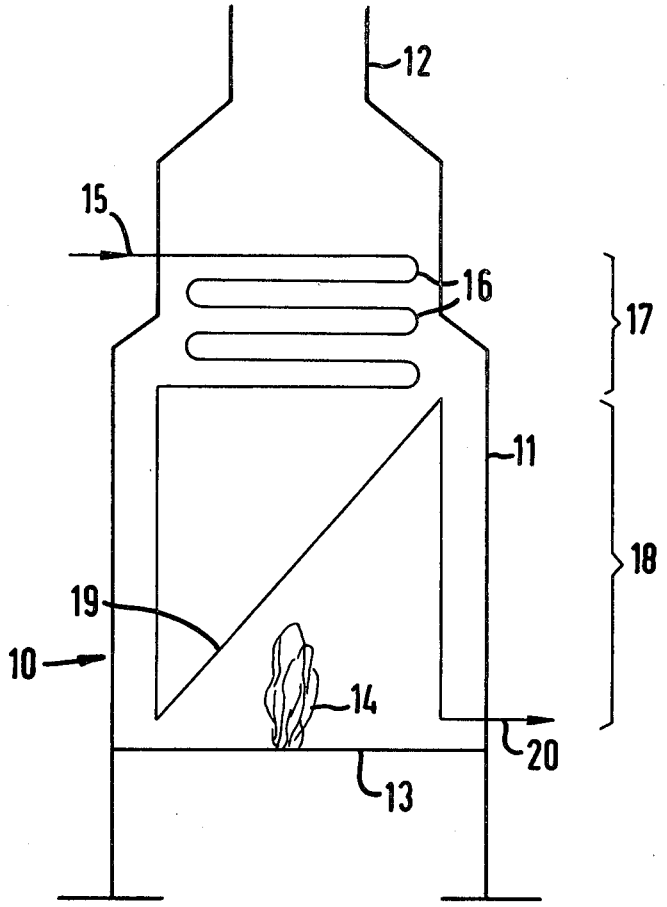

The present invention relates to supporting the weight of a structure in a hot environment, and more particularly, but not exclusively, to supporting the weight of a structure which is exposed to a hot fluid.

When at least part of the weight of a structure exposed to a hot environment has to be supported, the supporting means is either (1) so disposed as to be outside the hot environment, or (2) is within the hot environment and formed either of high temperature-resistant alloy or of a cheaper material which is protected against the action of the high temperature or adapted for strength at high temperatures. In the latter two cases, the supporting means may be cooled so that its strength is at least adequate to support the weight. In some instances, the weight of such a structure is supported by more than one of the foregoing types of supporting means.

In many cases, at least some of the weight of a structure must be supported by cooled means within the hot environment. A comon arrangement for these cases is to box in the open sides of an I-section support beam or girder with thin sheet metal to form a conduit on each side of the central web and to blow air and/or steam through the conduits. A drawback of this arrangement is that machinery and power are required to blow the air and/or steam through the conduit. An alternative arrangement is to employ the draught of a chimney stack to suck air through the conduits, but this has the drawback of reducing the draught of the chimney stack. A disadvantage common to the foregoing arrangements is that the heat extracted by the cooling air and/or steam is available at such a low temperature, which is generally unpredictable, on discharge from the conduits that the extracted heat cannot normally be used, and as a result, the thermal efficiency of the equipment in which the hot environment is produced is reduced.

The present invention, in one aspect, provides a method of supporting at least part of the weight of a structure exposed to a hot environment in which at least part of the weight of the structure is supported on and/or by at least one substantially horizontal multi-pipe heat exchanger exposed between its ends to a region containing the hot environment, the multi-pipe heat exchanger being supported at and/or on each side of said region and a coolant fluid being passed into one pipe of the multi-pipe heat exchanger and recovered from another pipe thereof so as to maintain the heat exchanger at such a temperature that the strength thereof is sufficient to support the said part of the weight of the structure.

A multi-pipe heat exchanger is defined as a heat exchanger comprising an outer conduit surrounding at least one inner conduit and arranged to provide a flow channel for fluid between the outer wall(s) of the inner conduit(s) and the inner wall of the outer conduit, and wherein there may be a plurality of inner conduits arranged side-by-side within the outer conduit or one-within-the-other or so disposed that some inner conduits are side-by-side and some are one-within-the-other.

Preferably, the coolant fluid enters the heat exchanger on the same side of the said region as it leaves the heat exchanger.

The heat exchanger may be fixed at one end, the other end being free to accommodate thermal expansion and contraction.

The hot environment may be provided by a hot fluid. The hot fluid may be a gas containing a sulfur oxide and water (e.g. the gas may be a flue gas), and the coolant fluid is preferably passed through the heat exchanger in such a manner as to maintain the temperature of the heat exchanger contacted by the hot gas above the dew point.

The structure may comprise a heat transfer apparatus for transferring heat from the hot environment to a heat exchange fluid passing through the heat transfer apparatus.

At least some of the said heat exchange fluid may be constituted by at least some of the coolant fluid recovered from the multi-pipe heat exchanger.

The hot region may have a temperature of 800° C. or more, e.g. 900° to 1350° C., and in some instances (e.g. a steam cracking furnace wherein the said structure comprises the cracking coils), temperatures may be in the range of from 925° to 1315° C.

In another aspect, the invention provides a combination comprising means defining a region for containing a hot environment, at least one substantially horizontal multi-pipe heat exchanger exposed between its ends to the said region, support means supporting the heat exchanger at and/or on opposite sides of the said region, and a structure which has at least part in said region and of which at least part of the weight is supported on and/or by the said heat exchanger.

Preferably, means are provided which are connected or connectible to the heat exchanger for passing a coolant fluid thereinto at such a rate as to maintain the temperature of the heat exchanger in a range at which the strength of the heat exchanger is sufficient to support the said part of the weight of the structure, during operation.

The combination may comprise a conduit for conducting at least some of the coolant fluid from an outlet of the heat exchanger to an inlet of a heat transfer apparatus constituting at least part of the said structure whereby, during operation, at least some of the coolant fluid constitutes at least part of a heat exchange fluid which is passed through the heat transfer apparatus.

The invention also provides a furnace or a similar heating installation comprising a combination as described above.

Preferably, the invention is so practised that the outermost pipe of the multi-pipe heat exchanger has dimensions which are at least adequate to support the load imposed by the said part of the weight of the structure at the operational temperature of the outermost pipe. The outermost pipe functions as a hollow support beam, and it may have any cross-sectional shape - e.g. circular, rectangular, square, inter alia. Rectangular (e.g. square) cross-sectional shapes are preferred for their ease of interfit with other items of equipment. The inner pipe(s) are preferably sized in a manner well-known in the art to provide adequate control of the operational temperature of the outermost pipe, preferably with an acceptable flow rate of the coolant fluid. The temperature control may be modified for a given flow area in the inner pipe(s) and a given coolant flow rate by the use of extended heat transfer surfaces associated with the inner pipe(s) and/or the outer pipe. The operational temperature of the outermost pipe will depend on the material it is made from. A low-cost carbon steel outermost pipe would have an outer surface temperature not exceeding 400° C. or thereabouts, and the corresponding maximum surface temperatures for Cr(2½%) Mo(1%) steel would be about 540° C. and for 18/8 stainless steel about 790° C. It will be appreciated that it is not necessary to employ expensive heat-resistant materials such as HK-40, or to employ thermal insulation to protect the outermost pipe against the effects of high temperatures.

Figure 2:
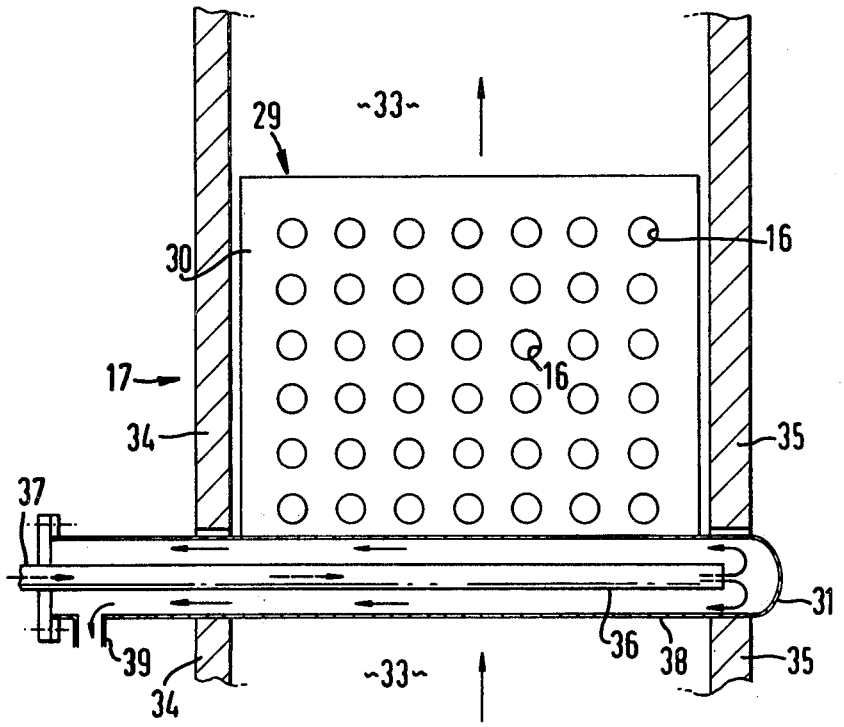

The invention is now described with reference to the accompanying diagrammatic drawings in which:

FIG. 1 is a diagrammatic vertical sectional elevation of a process fluid heating furnace, (e.g. a steam cracking furnace for olefins production or a visbreaking furnace), and FIG. 2 is a diagram of part of a furnace, like that shown in FIG. 1, in accordance with the invention.

Referring first to FIG. 1, the furnace 10 comprises vertical walls 11 lined with refractory which define a number of sections of reduced horizontal cross-sectional area at the higher levels and which sections are connected by sloping sections. The top section 12 is connected to a stack (not shown) for the discharge of combustion gases from the top of the furnace 10.

Near the base of the furnace are provided a suitable number of burners (not shown) supported by a furnace floor 13. The or each burner is supplied with fuel which is burned in a flame 14 above the floor 13. In the vicinity of flame 14, there is intense radiation and at more remote locations above the flame, most of the heating effect of the flame is by convection through the medium of the combustion gases and hot excess air.

Most fuels contain sulfur and in consequence the combustion gases contain sulfur oxides in addition to the water vapour produced by the oxidation of the hydrogen-containing components of the fuel.

Generally speaking, the process fluid which is to be heated is passed more or less countercurrently relative to the combustion gases so that cool fluid is employed to recover heat from the combustion gases near the top of the furnace mainly by convective heat transfer, and heated fluid is finally heated mainly by radiant heat transfer in the vicinity of the flame 14. Thus, as will be seen from FIG. 1, the process fluid enters the furnace 10 near the top via tube 15 and passes through one (or more) sets or banks of tubes 16 disposed in a convection section 17 of the furnace for recovery of heat from the hot combustion gases passing upwardly towards the top section 12 and stack from a lower section 18 comprising a firebox. The fluid passes through tubes 16 in a generally countercurrent path to the combustion gases and relatively hot fluid circulates from the tubes 16 to one or more banks of tubes 19 in the lower section 18 surrounding the flame wherein a major proportion of high temperature heat is recovered from the radiation in the lower section 18. The fluid leaves the tube bank(s) 19 via outlet(s) 20 at a relatively high temperature.

The tubes 16 in the convection section 17 are usually supported by a tube sheet (not shown in FIG. 1) at each end of the respective bank (and also, often, at intermediate positions, not shown), and the tube sheets are usually of cast iron or steel or high temperature cast alloys. It will be appreciated that for many furnaces of the type described in relation to FIG. 1, a convection bank of tubes 16 can be very heavy, even in a furnace of modest output, and commonly such a bank has a weight of several tonnes. Some of this weight can be supported from a relatively cool region above the convection section 17, but at least some of the load must be supported in the hottest region—i.e. at the bottom of section 17 in the furnace 10. Moreover, the support for the tube bank preferably must be able to accommodate thermal expansion and contraction movements so that the predicted working life of the tubes 16 is attained, particularly when a process fluid passing through the bank is flammable and/or under relatively high pressure.

Reference is now made to FIG. 2 wherein a bank 29 of the tubes 16 of the convection section 17 is shown received at one end in a tube sheet 30. The tubes 16 are shown in vertical cross sectional elevation. Other like tube sheets (not shown) are provided at the other end of the tubes 16 and at intermediate locations.

At least part of the weight of the bank 29 and tube sheets 30 is taken by one or more double pipe heat exchangers 31 (of which only one is shown in FIG. 2). The bank 29 and tube sheets 30 may rest directly upon the heat exchangers 31 or indirectly through suitable intermediate members (not shown). Each heat exchanger 31 extends across the hot gas flow path 33 defined between vertical walls 34, 35 of the convection section 17 of the furnace, and is received in and supported by the vertical walls 34, 35 on each side of the path 33. The heat exchangers 31 may be directly supported on one or both walls or indirectly through a suitable intermediate member (not shown).

The heat exchangers 31 may also be arranged with their inlets and outlets on the same side of path 17, but in some cases, other arrangements may be more suitable and/or convenient. As shown in FIG. 2, the heat exchanger 31 has its inlet and outlet adjacent to wall 34, and a coolant fluid is passed into the centre tube 36 at inlet end 37 and recovered from the outer tube 38 via outlet end 39. The coolant fluid is preferably passed through the heat exchanger 31 at such a rate that the outer surface of outer tubes 38 has a temperature above the dew point of the upwardly-rising hot gas in path 33 to avoid acid corrosion.

In order to accommodate thermal expansion and contraction, at least one end of the heat exchanger 31 is left free to move. Most conveniently, the end bearing the inlet and outlet is fixed (to wall 34) and the opposite end at wall 35 is not so fixed.

The dimensions of the outer pipe 38 are so chosen as to have adequate stiffness in bending to support the load imposed on it. The inner pipe 36 is sized to give a desired heat transfer between coolant fluid passing through the outer annulus (between pipes 36 and 38) and coolant fluid within pipe 36 at acceptable flow rates of the coolant fluid. The heat transfer characteristics can be modified in the known manner by the provision of fins, studs and other extended surfaces, and baffles, inside and/or outside one or both of the tubes 36 and/or 38.

The inner pipe 36 is substantially free of any load and may expand and contract without causing any difficulties.

It will be appreciated that the coolant fluid passed through the heat exchanger 31 may be any which is conveniently available and capable of maintaining the outer tube 38 at an adequately low temperature for supporting the load imposed thereon. The coolant fluid may be air, steam, water, or a process fluid such as a hydrocarbon feedstock. The temperature at which the coolant fluid is recovered at the outlet end 39 must be sufficiently low to maintain the load-supporting function of the outer pipe 38, but subject to this limitation, it may have any temperature. Thus, coolant fluid may be recovered from the heat exchanger 31 at a predictable temperature which is high enough to be useful. For example, if the coolant fluid is air, it may be withdrawn from the heat exchanger at a temperature sufficiently high to be used as heated combustion air for the burners, thereby reducing the load on an air preheater (not shown) of the furnace. In another example, when the coolant fluid is a process fluid (e.g. a hydrocarbon steam cracker or visbreaker feed), it may form at least part of the process fluid entering the tubes 16 of the convection section. In a further example, the coolant feed may be water or steam for use in steam cracking and/or for other industrial uses. Steam, e.g. for steam cracking, may be superheated in the heat exchanger to temperatures of from about 500° to 550° C., e.g. 530° C. Thus, because the heating of the coolant fluid in the heat exchanger 31 is substantially predictable, it is possible to employ the heat thus recovered rather than to have to discard it, thereby increasing the thermal efficiency of the furnace.

A further benefit of the practice of the invention is that the heat exchanger 31 can be completely drained of its contents, thereby permitting flushing out of debris, removal of e.g. hydrocarbons, inter alia, to reduce potential problems such as stress corrosion cracking and coking, inter alia, in certain applications.

Although in FIG. 2, the coolant fluid has been described as passing first through the inner pipe 36 and then through the outer pipe 38, it will be appreciated that the coolant fluid could be introduced first into the outer pipe 38 and recovered from the end 37 of the inner pipe 36 to increase the amount of cooling of the outer pipe 38. A potential drawback of this mode of operation when the hot gas in path 33 is obtained by burning fuels containing sulfur is that of acid corrosion but this can be mitigated at least to some extent by providing an adequate amount of heat exchange in the part of the heat exchanger 31 outside the path 33. However, when the problem of acid or other low temperature corrosion is not likely to be encountered (e.g. in supporting loads in nuclear reactors), it may be preferred to circulate the coolant fluid initially into the outer tube 38.

In most applications of the invention, it will be found convenient that the outer pipe 38 has a rectangular cross-section so that potential problems concerning interfitting the heat exchanger 31 with other items of equipment are mitigated or substantially avoided. The inner pipe(s) 36 may have any form (e.g. circular cross-section and optionally provided with extended heat transfer surfaces, not shown) which is convenient and effective for the purpose of ensuring adequate heat transfer from the outer pipe 38 to maintain the strength of the latter at an acceptable fluid flow-rate through the heat exchanger 31. The selection of outer and inner pipes 38,36 commensurate with the foregoing is well within the compass of skill of a competent technologist in this field. The invention is not restricted to the particular uses hereinbefore mentioned, but may be applied more widely—e.g. to a hydrocarbon reformer unit wherein the temperature in the convection section of the furnace is usually high, and to combustion equipment generally.

I claim:

1. In combination, a furnace having an array of generally horizontal furnace tubes extending between side walls of said furnace, said tubes extending through and being held in spaced relation by a plurality of generally vertical disposed tube sheets; and support means for each of said tube sheets, each said support means being in contact with a lower portion of its respective tube sheet to support the weight thereof and comprising an outer tube having a closed end and extending through and engaging apertures in the furnace side walls, an inner tube disposed within said outer tube and extending from one end of said outer tube to a point adjacent the closed end of said outer tube, said inner tube having an outside dimension less than the inside dimension of said outer tube to define a liquid passageway therebetween, and means for circulating a coolant liquid through said passageway to thereby cool said support means and maintaining it at such a temperature that the strength thereof is sufficient to support its respective tube sheet.

2. The combination of claim 1 wherein each support means is fixed at one end relative to the furnace side wall and free to accommodate thermal expansion and contraction at its other end.

3. The combination of claim 1 wherein the outer tube is rectangular in cross-section.

4. The combination of claim 1 wherein the coolant liquid is first introduced into said inner tube and subsequently flows through said passageway and discharged from said outer tube.

* * * * *